United States Patent [19]

Garrison

[11] Patent Number: 5,033,718

[45] Date of Patent: Jul. 23, 1991

[54] STAPLE REMOVING APPARATUS

[76] Inventor: Jean Garrison, 1500 W. 31 St., Minneapolis, Minn. 55408

[21] Appl. No.: 464,911

[22] Filed: Jan. 16, 1990

[51] Int. Cl.[5] ..... B25C 11/00

[52] U.S. Cl. ..... 254/28; 254/104

[58] Field of Search ..... 254/28, 25, 18, 104; 29/268, 283.5; 81/415, 424

[56] References Cited

U.S. PATENT DOCUMENTS

| | | | |
|---|---|---|---|
| 129,412 | 7/1872 | Jackson . | |
| 1,153,904 | 9/1915 | Freeman . | |
| 1,160,568 | 11/1915 | Bottle . | |
| 2,202,984 | 6/1940 | Drypolcher . | |
| 2,375,942 | 5/1945 | Palmer | 254/28 |
| 2,539,171 | 1/1951 | Yerkes . | |
| 2,623,729 | 12/1952 | Selby . | |
| 3,126,195 | 3/1964 | Taylor | 254/28 |
| 4,026,521 | 5/1977 | Clark . | |
| 4,455,736 | 6/1984 | Owen | 254/28 |

*Primary Examiner*—Robert C. Watson

*Attorney, Agent, or Firm*—Merchant, Gould, Smith, Edell, Welter & Schmidt

[57] ABSTRACT

The present invention provides a method and an apparatus for removing a staple from a stack of sheet goods bound by that staple. The stack of sheet goods is clamped, and the staple is directly engaged at both the crossbar and the clinched legs. The clinched legs are substantially straightened, and the staple is removed by pulling the crossbar away from the stack of sheet goods and the substantially straightened legs through the stack of sheet goods.

11 Claims, 3 Drawing Sheets

FIG. 3
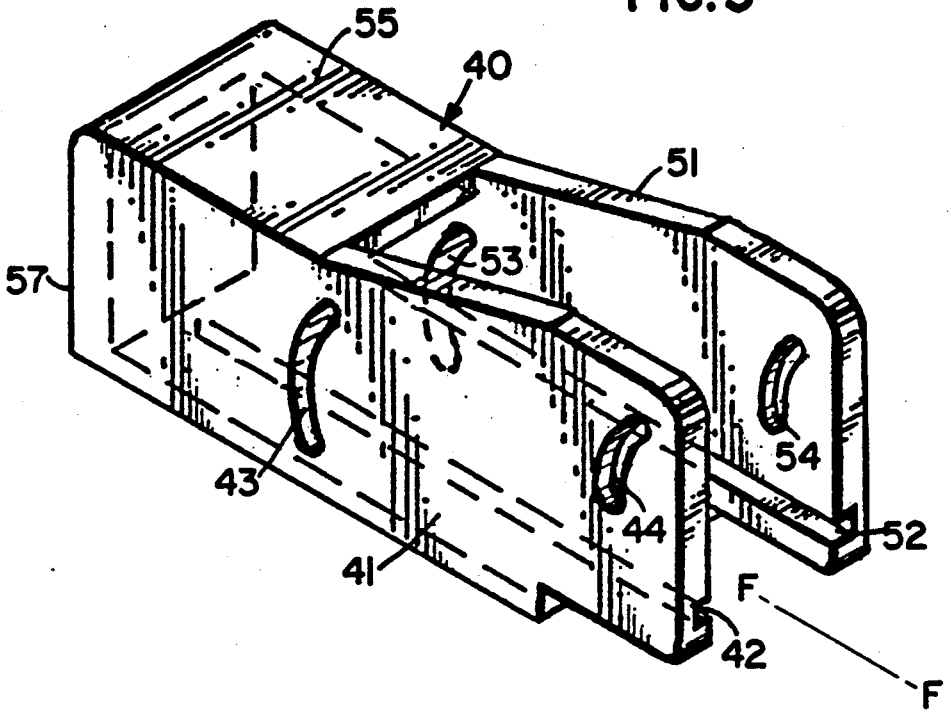
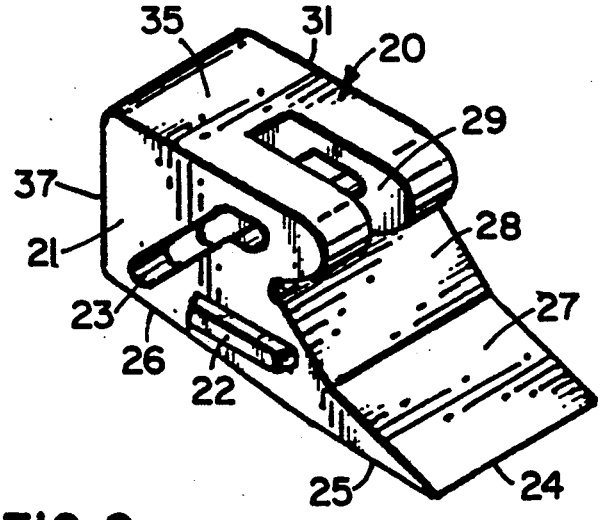
FIG. 2

STAPLE REMOVING APPARATUS

BACKGROUND OF THE INVENTION

1. Field of the Invention

This invention relates generally to office equipment, and more specifically, to an improved method and apparatus for removing a fastened staple from a stack of sheet goods.

2. Description of the Prior Art

Staple removing devices have long been known in the art. Their construction has been dictated to some extent by the properties and methods of use of the staple itself. Staples that are continuously driven into a substrate and which are used to retainably hold another article to the substrate (such as fencing staples) use the frictional force of their embedded legs to fasten the staple to the substrate. Such staples must by necessity be removed by pulling the staple legs out of the substrate by means of the crossbar member portion of the staple. A plier-type of staple remover or a specially designed hammer claw has generally been used for such purposes. Both such removal devices grasp the staple crossbar and then generally use the solid substrate itself as a fulcrum for providing leverage against the crossbar, to pull the staple legs out of the substrate.

Staples used for binding together sheet goods, such as paper, cannot generally be removed by those staple removers described above. The legs of a staple used for binding sheet goods pass through the sheet goods and are bent backwards toward the sheet goods so as to retainably bind or clinch the sheet goods between the bent legs and the crossbar. Since the sheet goods being bound are generally relatively thin and pliable (such as paper) they cannot be directly pried against by the staple remover or used for providing leverage in removing the staple, as is the case when a rigid substrate is used. Further, if one attempts to remove the staple by simply grasping the staple crossbar and pulling it away from the sheet goods, the bent or clinched legs of the staple will also pull through the sheet goods in their bent position, tearing the sheet goods in the process. In order to prevent damage to the sheet goods in the removal process, the staple remover must straighten the clinched legs so they can be longitudinally pulled or pushed through the sheet goods, generally in the opposite direction through which they originally entered the sheet goods.

While a number of staple remover configurations for removing staples binding sheet goods have been developed over the years, the most commonly used such device today employs a pair of opposed lever arms having facing curved claw members that cooperatively engage and lift the staple crossbar member from a position directly below and between the crossbar and the sheet goods on which it rests. This staple removing device, which for simplicity will hereinafter be referred to as to the "standard" staple remover, requires the operator to apply force to the pair of lever arms at positions generally overlying the claw members such that any mechanical advantage of the device's lever arms is negated. Also, the standard staple remover operates totally from one side of the sheet goods (i.e. the side on which the staple crossbar is disposed). The standard staple remover transmits forces for bending or straightening the clinched staple legs through the sheet goods, from positions directly underlying the staple crossbar. The underside of the crossbar itself is used by the remover claw members as the reactive surface from which straightening forces are transmitted through the sheet goods as the members are squeezed together to lift the crossbar away from the sheet goods.

One problem associated with the standard staple remover concerns its use in removing heavy duty staples and staples fastening large stacks of sheet goods. In such cases, due to the lack of any significant mechanical advantage of the standard staple remover, an operator generally simply engages the staple crossbar with the opposed claw members and "pulls" the staple through the sheet goods, relying on the strength of the combined sheet goods to provide the required reactive force for straightening the clinched legs of the staple. The standard staple remover is not designed to handle such "heavy-duty" applications. When used for such applications, it is often difficult for the operator of the staple remover to hold and pull the staple crossbar with sufficient force to cause the clinched legs of a heavy duty staple to sufficiently straighten, so that the staple may be pulled through the stack of sheet goods. Also, with a large stack of sheet goods, it is often the case that one leg of the staple will be removed while the other leg remains clinched or retainably held by the sheet goods. Thus, it is desirable to have a staple remover that does not require excessive operator force to straighten a heavy duty staple or to remove a staple from a thick stack of sheet goods. Furthermore, it is desirable to have a staple remover that consistently straightens both clinched legs of a heavy duty staple, so that both legs of the staple may be consistently pulled through the stack of sheet goods.

A second commonly encountered problem with the standard staple remover concerns its use on staples that have been machine-fastened, as occurs when automatic staplers and/or copying machines are used. Staples applied by these devices tend to be more tightly clinched, making it more difficult to straighten the clinched legs by simply applying a removal force to the staple crossbar from one side of the sheet goods. Thus, it is desirable to have a staple remover that consistently and effectively straightens the clinched legs of a machine-fastened staple, so that it can be more readily removed.

Yet another problem associated with the standard staple remover is that the remover does not positively secure the sheet goods separate from the staple during the removal process. As discussed above, the movable claw members of the standard staple remover cooperatively slide under the staple crossbar, simultaneously providing opposing forces between the lower side of the staple crossbar and the upper surface of the sheet goods upon which the crossbar rests. The claw surfaces engaging the surface of the sheet goods frictionally slide against the sheet good surface as the claws are squeezed together below the staple crossbar member. The sliding friction proportionately increases and the reaction force from the lower side of the staple crossbar increases as the claw members move toward one another. Such frictional sliding motion often results in physical tearing or ripping of the engaged sheet goods during the removal process.

Therefore, while the standard staple remover is well known and widely used, it does not satisfy many of the desired design attributes required of a staple remover that must operate in significantly different applications in the commercial/business environment. The present invention addresses most of the shortcomings of the prior art staple removers and, in particular, of the well known standard staple remover discussed above. The present invention provides a method and an apparatus for cooperatively clamping a stack of sheet goods that is bound by a staple, for substantially straightening the clinched legs of the staple, and for removing the staple by pulling the substantially straightened legs through the sheet goods with minimal operator effort and minimal damage to the sheet goods.

SUMMARY OF THE INVENTION

The present invention provides a method and an apparatus for removing a staple from a stack of sheet goods bound by that staple. After the staple is directly engaged at both the crossbar and the clinched legs, the clinched legs are substantially straightened, so that they may be more readily pulled through the stack of sheet goods. The more immediate and direct straightening of the clinched ends allows for more efficient and convenient removal of heavy duty staples and staples fastening large stack of sheet goods, as well as machine fastened staples. Additionally, the stack of sheet goods may be retained so that as the staple is removed, the stack of sheet goods remains effectively bound.

While the invention will be described with respect to a preferred embodiment of the staple remover, it will be understood that the invention is not limited to such design, but that the general principles of the invention apply to any and all staple removal devices. Further, the invention is not limited to any of the specifics of construction, other than as described within the appended claims. These and other variations of the invention will become apparent to those skilled in the art upon a more detailed description of the invention.

BRIEF DESCRIPTION OF THE DRAWING

FIG. 2 is an enlarged perspective view of the first wedge member of the staple remover of FIG. 1;

FIG. 3 is an enlarged perspective view of the first housing member of the staple remover of FIG. 1;

DESCRIPTION OF THE PREFERRED EMBODIMENT

Figure 1:
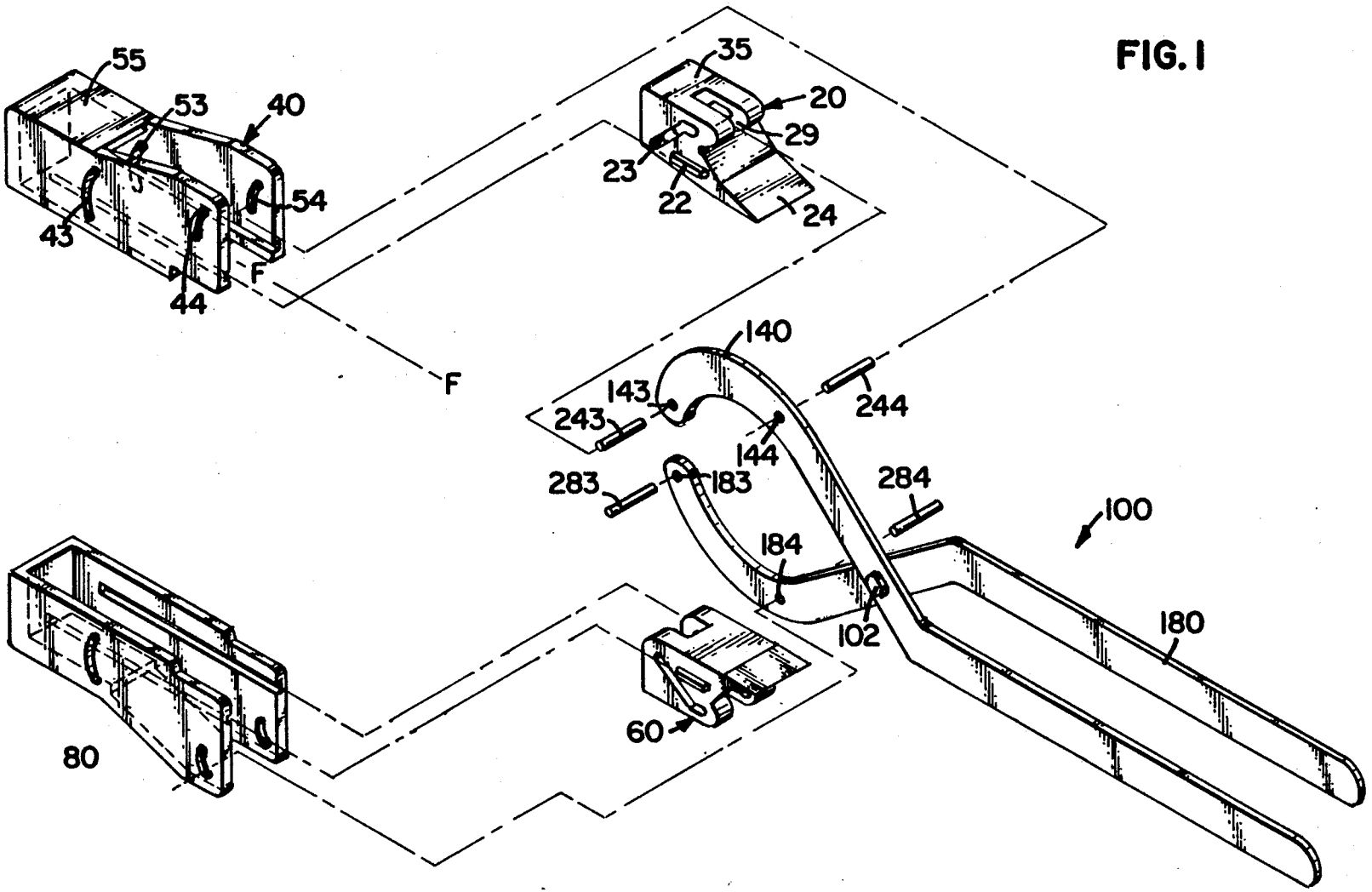
FIG. 1 is an exploded perspective view of the staple remover configured according to a preferred embodiment of the invention.

Referring to the Figures, wherein like numerals represent like parts throughout the several views, a preferred embodiment of the invention will be described with reference to its operating position relative to a stack of sheet goods. As shown in FIG. 1, the staple remover includes a first wedge member 20, a first housing member 40, a second wedge member 60, a second housing member 80, a handle 100, and four pins 243, 244, 283 and 284. The handle 100 includes a first handle member 140 and a second handle member 180. The first handle member 140 has an outer pin hole 143 and an inner pin hole 144. Also, the first handle member 140 has a notched section (not shown) and a pivot hole centered within the notched section (also not shown). The second handle member 180 is identical to the first handle member 140, in that it has corresponding pin holes 183 and 184 and notched section, and pivot hole (not shown). Additionally, the pivot hole of the second handle member 180 is threaded. The second handle member 180 is rotated 180° about its longitudinal axis relative to the first handle member 140, so that it opposes the first handle member 140 as illustrated, and the notched sections engage one another, and the pivot holes align with one another. A spring member (not shown) is set within the notched sections in such a manner that the spring member exerts a force on the handle members 140 and 180 that urges the opposing like ends of the handle members 140 and 180 apart. A screw 102 passes through the pivot hole of the first handle member 140 and the spring member and screws into the threads in the pivot hole of the second handle member 180 to secure the handle members 140 and 180 to one another and the spring member therebetween and to provide a plier-like handle configuration.

FIG. 2 provides an enlarged view of the first wedge member 20, The first wedge member 20 has a lower side, which includes a first contact surface 25 and a second contact surface 26, and an upper side 35, all of which are substantially parallel to one another and to the stack of sheet goods when the staple remover is in its operation position. The respective planes of the first and second contact surfaces lie at a slight angle relative to one another with the plane of the second contact surface angling slightly toward the upper side 35. The first wedge member 20 also has a first engagement surface 27 angling back and upward from wedge edge 24 and a second engagement surface 28 continuously extending at an increased angle from the first engagement section 27. The first wedge member 20 further has first and second sides 21 and 31 and a back side generally illustrated at 37. The first side 21 has a key 22 protruding therefrom and a camming slot 23 formed therein. The key 22 extends along a line FF substantially parallel to the stack of sheet goods and substantially perpendicular to a plane defined by the crossbar and clinched legs of a staple when the staple remover is in its operating position. The first wedge member 20 is symmetrical so that the second side 31 forms a mirror image of the first side 21, with corresponding key and camming slot (not shown). Finally, the first wedge member 20 defines a center slot 29 passing through the center of the first wedge member 20 in a manner that substantially parallels the camming slots.

Figure 5:
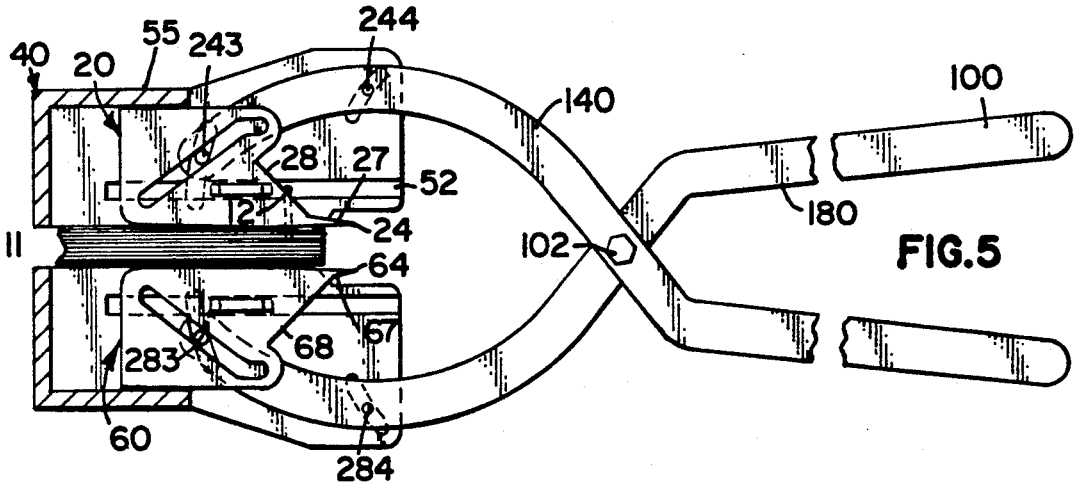
FIG. 5 illustrates the staple remover of FIG. 1, in side elevational view with portions thereof broken away as it appears after substantially straightening the clinched legs of the staple binding the sheet goods shown relative thereto.
Figure 6:
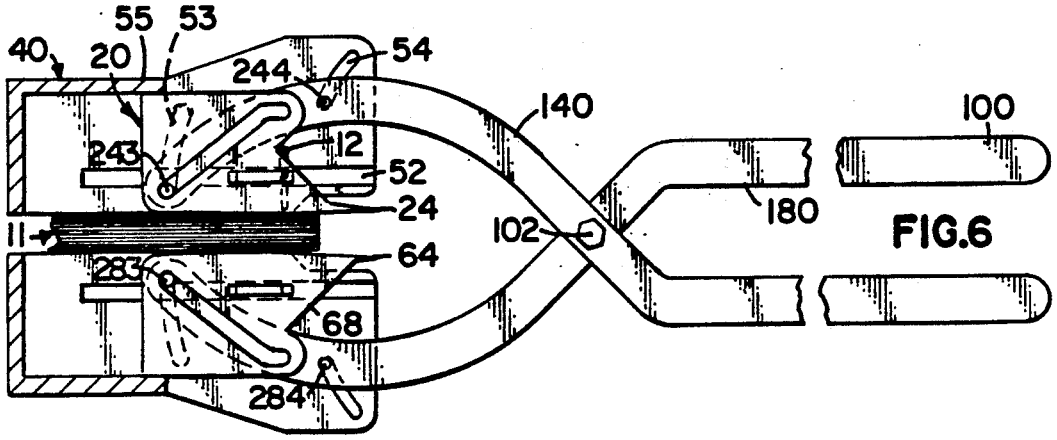
FIG. 6 illustrates the staple remover of FIG. 1, in side elevational view with portions thereof broken away as it appears after pulling the substantially straightened clinched ends of the staple through the sheet goods shown relative thereto.

Referring to FIG. 1, the second wedge member 60 is generally identical and diametrically opposed to the first wedge member 20 with one exception. Referring to FIG. 5, the length of the first engagement surface 67 of the second wedge member 60, as measured back from wedge edge 64, is shorter than that of the first engagement surface 27 of the first wedge member 20, as measured back from wedge edge 24, and, thus, the second engagement surface 68 is relatively longer than the second engagement surface 28.

FIG. 3 provides an enlarged view of the first housing member 40. The first housing member 40 has a top side 55 that is substantially parallel to the stack of sheet goods when the staple remover is in its operating position, as shown in FIG. 5, and a back side 57 that defines a plane substantially normal to the line FF. Additionally, the first housing member 40 has a first side 41, in which a keyway 42, an outer slot 43, and an inner slot 44 are formed. The keyway 42 extends along the line FF. The first housing member 40 is symmetrical, so that the second side 51 forms a mirror image to the first side 41, with corresponding keyway 52, outer slot 53, and inner slot 54. Referring to FIG. 1, note that the second housing member 80 is identical and diametrically opposed to the first housing member 40.

Figure 4:
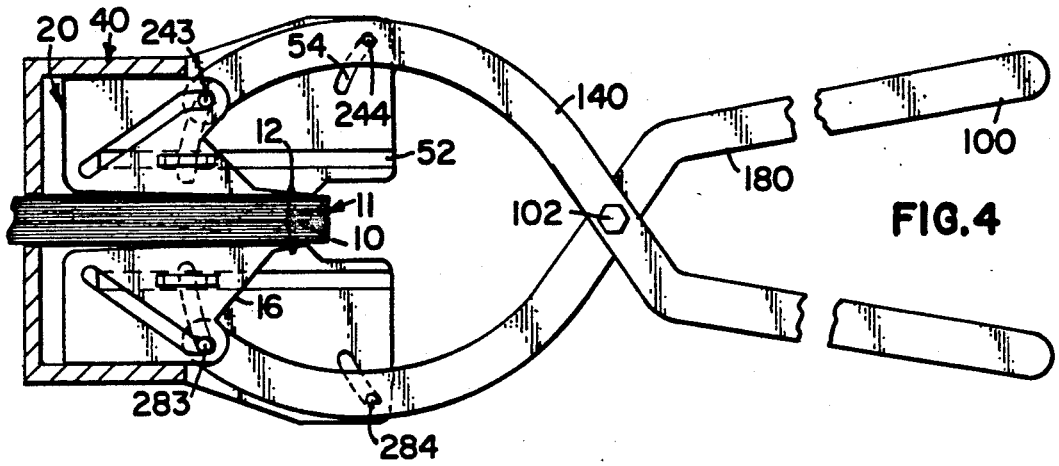
FIG. 4 illustrates the staple remover of FIG. 1, in side elevational view with portions thereof broken away as it appears in a first clamping position relative to a stack of sheet goods bound together by a staple.

Again referring to FIG. 1, note that the first wedge member 20 fits within the first housing member 40 in such a manner that the keys (not labeled) slideably engage the keyways (also not labeled). Thus, the first wedge member 20 is confined to movement back and forth along the line FF. Referring to FIG. 4, as the first wedge member 20 slides into the first housing member 40, the camming slots of the first wedge member 20 align with the outer slots of the first cover member 40. The second wedge member 60 and the second housing member 80 similarly interact, with corresponding keys slideably engaging corresponding keyways, and with corresponding camming slots aligning with corresponding outer slots.

Referring to FIG. 4, the first handle member 140 fits within the center slot of the first wedge member 20 in such a manner that the outer pin hole 143 aligns with the camming slots of the first wedge member 20 and the outer slots of the first cover member 40. The outer pin 243 passes through the camming slot and the outer slot on the first sides of the first wedge member 20 and first housing member 40, respectively, frictionally engages the outer pin hole of the first handle member 140, and passes through the opposing camming slot and outer slot on the second sides of the first wedge member and first housing member, respectively. Thus, the pin 243 is secured within the outer pin hole of the first handle member 140 but free to slide relative to the camming slots of the first wedge member 20 and the outer slots of the first housing member 40. Additionally, the inner pin hole of the first handle member aligns with the inner slots of the first housing member 40. The inner pin 244 passes through the inner slot on the first side of the first housing member 40, frictionally engages the inner pin hole of the first handle member 140, and passes through the opposing inner slot 54 on the second side of the first housing member 40. Thus, the inner pin 244 is secured within the inner pin hole of the first handle member 140 but free to slide relative to the inner slots of the first housing member 40. The second handle member 180 and the outer pin 283 similarly interact with the second wedge member 60 and the second housing member 80, so that the outer pin 283 is secured within the corresponding outer pin hole but free to slide relative to the corresponding camming slots and outer slots. Also, the second handle member 180 and the inner pin 283 similarly interact with the second housing member, so that inner pin 284 is secured within the corresponding inner pin hole but free to slide relative to the corresponding inner slots.

As the ends of the handle members 140 and 180 opposite the outer pins 243 and 283 are forced toward one another, the ends securing the pins 243 and 283 are also forced toward one another. The result is that the outer pins 143 and 183 and the inner pins 144 and 184 move toward the stack of sheet gods 11 and relative to the camming slots and outer slots and to the inner slots, respectively. Because the movement of the outer pins 143 and 183 is limited to the path defined by the outer slots of the housing member, the wedge members must travel away from the back sides of the housing members, in order to accommodate the movement of the outer pins 143 and 183 in the camming slots, toward the stack of sheet goods.

FIG. 4 shows the staple remover as it engages a staple 10 to be removed. The outer pins 143 and 183 and the inner pins 144 and 184 are at or substantially near the ends further from the stack of sheet goods of the outer slots and the inner slots, respectively, and the wedge members are relatively near the back sides of the housing members. The housing members are clamping the stack of sheet goods 11, and the first engagement surfaces of the wedge members are engaging the crossbar 12 and the clinched legs of the staple 16, respectively.

As already noted, additional squeezing of the handle members 140 and 180 causes the outer pins 143 and 183 and the inner pins 144 and 184 to move toward the stack of sheet goods 11 and the wedge members to slide toward the staple 10. The second engagement surface of the second wedge member engages and substantially straightens the clinched legs of the staple 16. As the wedge members continue sliding relative to the cover members, the second engagement surface of the first wedge member engages the crossbar 12 and substantially pulls the staple 10 until it is effectively removed from the stack of sheet goods 11.

While a specific embodiment of the invention has been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. An apparatus for removing a staple from a stack of sheet goods bound thereby, said staple having a crossbar and two clinched legs, comprising:

(a) means for directly engaging said staple at said crossbar;

(b) means for directly engaging said staple at said clinched legs and for substantially straightening said clinched legs, wherein said clinched legs engaging means applies an unclinching force on said clinched legs, said unclinching force having a component in a direction perpendicular to and away from said stack of sheet goods and a component in a direction parallel to said stack of sheet goods and perpendicular to a plane defined by said crossbar and said clinched legs; and (c) means for removing said staple from said stack of sheet goods, whereby said clinched legs, having been substantially straightened, are pulled through said stack of sheet goods.

2. An apparatus according to claim 1, wherein said staple removing means applies a removal force on said crossbar, said removal force having a component in a direction perpendicular to and away from said stack of sheet goods and a component in a direction parallel to said stack of sheet goods and perpendicular to a plane defined by said crossbar and said clinched legs.

3. An apparatus according to claim 2, further comprising means for retaining said stack of sheet goods, whereby when said staple is removed, said stack of sheet goods is not free to become unstacked.

4. An apparatus for removing a staple from a stack of sheet goods bound thereby, said staple having a crossbar and two clinched legs, comprising:

(a) means for directly engaging said staple at said crossbar;

(b) means for directly engaging said staple at said clinched legs and for substantially straightening said clinched legs;

(c) means for operatively connecting said crossbar engaging means and said clinched legs engaging means, wherein said crossbar engaging means moves in conjunction with said clinched legs engaging means; and (d) means for removing said staple from said stack of sheet goods, whereby said clinched legs, having been substantially straightened, are pulled through said stack of sheet goods.

5. An apparatus for removing a staple from a stack of sheet goods bound thereby, said staple having a crossbar and two clinched legs, comprising:

(a) means for directly engaging said staple at said crossbar;

(b) means for directly engaging said staple at said clinched legs and for substantially straightening said clinched legs; and (c) means for removing said staple from said stack of sheet goods, whereby said clinched legs, having been substantially straightened, are pulled through said stack of sheet goods, wherein said crossbar engaging means and said staple removing means include a first wedge member, and wherein said clinched leg engaging means includes a second wedge member, whereby said second wedge member engages and substantially straightens said clinched legs, and said first wedge member engages said crossbar and removes said staple.

6. An apparatus according to claim 5, further comprising means for retaining said stack of sheet goods against relative movement, whereby as said staple is removed said stack of sheet goods remains effectively bound.

7. An apparatus according to claim 6, wherein said second wedge member applies an unclinching force on said clinched legs, said unclinching force having a component in a direction perpendicular to and away from said stack of sheets goods and a component in a direction parallel to said stack of sheet goods and perpendicular to a plane defined by said crossbar and said clinched legs.

8. An apparatus according to claim 7, wherein said first wedge member applies a removal force on said crossbar, said removal force having a component in a direction perpendicular to and away from said stack of sheet goods and a component in a direction parallel to said stack of sheet goods and perpendicular to a plane defined by said crossbar and said clinched legs.

9. An apparatus for removing a staple from a stack of sheet goods bound thereby, said staple lying in a plane and having a crossbar and two clinched legs, comprising:

(a) first wedge means for directly engaging said cross bar and pulling said crossbar away from said stack of sheet goods, whereby said staple is removed;

(b) second wedge means for directly engaging said clinched legs and substantially straightening said clinched legs;

(c) first and second housing means cooperatively connected with said first and second wedge means for clamping said stack of sheet goods therebetween and defining paths of movement for said first and second wedge means; and (d) plier-like handle means for cooperatively moving said first and second wedge means and said first and second housing means.

10. An apparatus according to claim 9, wherein each of said said wedge means includes a first contact surface and a second contact surface, and said contact surfaces being disposed at a slight angle relative to one another; and wherein each of said first and second wedge means includes a first engagement surface and a second engagement surface, said second engagement surface being relatively more inclined than said first engagement surface as measured with reference to said stack of sheet goods; and wherein a projection of said first engagement surface of said second wedge means in a direction normal to a plane defined by said crossbar and said clinched legs is relatively shorter than that of said first engagement surface of said first wedge means; whereby said second wedge means begins straightening said clinched legs before said first wedge means begins pulling said crossbar away from said stack of sheet goods.

11. An apparatus according to claim 9, including means cooperatively connecting said first and second wedge means, said first and second housing means, and said handle means for sequentially cooperatively causing said first and second housing means to clamp the sheet goods and cooperatively moveing said first and second wedge means to engage the staple.

* * * * *